United States Patent [19]

Workman

[11] 4,100,958

[45] Jul. 18, 1978

[54] MOULDING PROCESS FOR METALS

[76] Inventor: John Workman, Lough House, Greyabbey, County Down, Northern Ireland

[21] Appl. No.: 761,625

[22] Filed: Jan. 24, 1977

Related U.S. Application Data

[62] Division of Ser. No. 653,891, Jan. 30, 1976, abandoned.

[30] Foreign Application Priority Data

Jan. 31, 1975 [GB] United Kingdom ..... 4222/75

[51] Int. Cl.[2] ..... B22D 9/00

[52] U.S. Cl. ..... 164/7; 164/30; 164/340

[58] Field of Search ..... 164/7, 137, 160, 30, 164/31, 340

[56] References Cited

U.S. PATENT DOCUMENTS 3,960,198 6/1976 Matsuura et al. ..... 164/7

FOREIGN PATENT DOCUMENTS 2,417,113 10/1975 Fed. Rep. of Germany ..... 164/7

2,603,602 8/1976 Fed. Rep. of Germany ..... 164/160

*Primary Examiner*—Richard B. Lazarus

*Attorney, Agent, or Firm*—Mason, Fenwick & Lawrence

[57] ABSTRACT

A Vacuum-sealed moulding process for casting of materials comprises formation of sand moulds in the absence of a pattern plate and with cores supported in the mould by suction. Handling apparatus for producing the mould on a vibratory vacuum table is disclosed and this incorporates a pneumatic sand transfer apparatus delivering a predetermined quantity of sand to the mould box.

3 Claims, 16 Drawing Figures

33
34
35
36
V 37
36A

MOULDING PROCESS FOR METALS

This is a division of application Ser. No. 653,891, filed Jan. 30, 1976, and now abandoned.

This invention relates to methods and apparatus for use in the casting of materials, in particular by use of the vacuum-sealed moulding process.

The vacuum-sealed moulding process was discovered in 1972 and is described in an article entitled "Production of Castings by the Vacuum-sealed Moulding Process using Binderless Sand" which is printed in the *Foundry Trade Journal* of June 6, 1974. Briefly, this moulding process is referred to as the "V-process" wherein sand moulds are formed in mould boxes with the sand grains held together by subatmospheric pressure applied to the body of sand grains which is covered at its exposed faces with films of plastics material.

The V-process differs from conventional moulding processes in that there is no requirement to use an organic binder material mixed with the sand grains. Thus sand can be be reused without reprocessing. However the mould boxes require to have perforated hollow walls and be pressurised to subatmospheric pressure (hence the term "vacuum") to enable the moulded sand shape to be maintained.

As is described in the above-mentioned article the V-process utilises, a pattern secured to a carrier box, a number of narrow passageways leading from the hollow interior of the carrier box to the surface of the pattern. A heated plastics film (about 0.1 mm thick) is draped over the pattern and caused to cling to the surface thereof by reducing the pressure in the interior of the carrier box to sub-atmospheric (by connection to a suction pump). A mould box is located around the periphery of the pattern and loaded with unbonded sand which is compacted by vibration. A further heated plastics film is placed on the exposed surface of the body of sand which is then subjected to sub-atmospheric pressure by virtue of a suction pump being connected to the mould box which has a perforated wall in contact with the body of sand. With this body of sand maintained at a sub-atmospheric pressure (of about 0.5 atmospheres) the moulded sand shape is maintained in a hard condition and can be removed from the pattern. Upper and lower mould halves produced in this manner can be subjected to pouring of metal immediately after the halves are brought together and the sub-atmospheric pressurising of the two sand bodies is maintained until the casting has cooled sufficiently to be released.

The present invention is concerned with the provision of cores in the mould, moulding upper and lower mould halves without planar abutting faces and with apparatus and equipment for carrying out the V-process.

According to the present invention there is provided apparatus for use in carrying out the V-process of casting, comprising a support structure incorporating a vibratory vacuum table, first and second frames located on opposite sides of said vacuum table, and first and second storage arrangements for storing pieces of plastics material, the first and second frames being respectively movable to receive a piece of plastics material from the storage arrangements and to transfer same to the vacuum table.

Also according to the present invention there is provided apparatus for transporting sand to a V-process mould box, comprising a hood having a flexible skirt adapted sealingly to be seated on the open end of the mould box, a holder for a predetermined quantity of sand having its upper surface exposed to atmosphere, and a connecting pipe between the base of the holder and the hood, sand transfer being effected by pressure reduction in the V-process mould box.

Also according to the present invention there is provided a method of forming a mould without a pattern plate, said method comprising locating a pattern on a vacuum table, the pattern having been rendered porous, incorporating a plurality of perforated tubes extending along the mould half interface and being connected to a suction pump, forming a V-process half mould around said pattern, inverting said half mould whilst retaining the pattern therein and forming the other half mould therearound.

Also according to the present invention there is provided a method of locating cores in V-processmoulds, comrpising the steps of perforating the film of plastics material in the region of the core print, and adhering the core to the core print by the effect of suction through said perforations.

Embodiments of the present invention will now be described by way of example with reference to the accompanying drawings in which, FIG. 1 substantially illustrates apparatus for moulding utilising the V-process;

Figure 1:
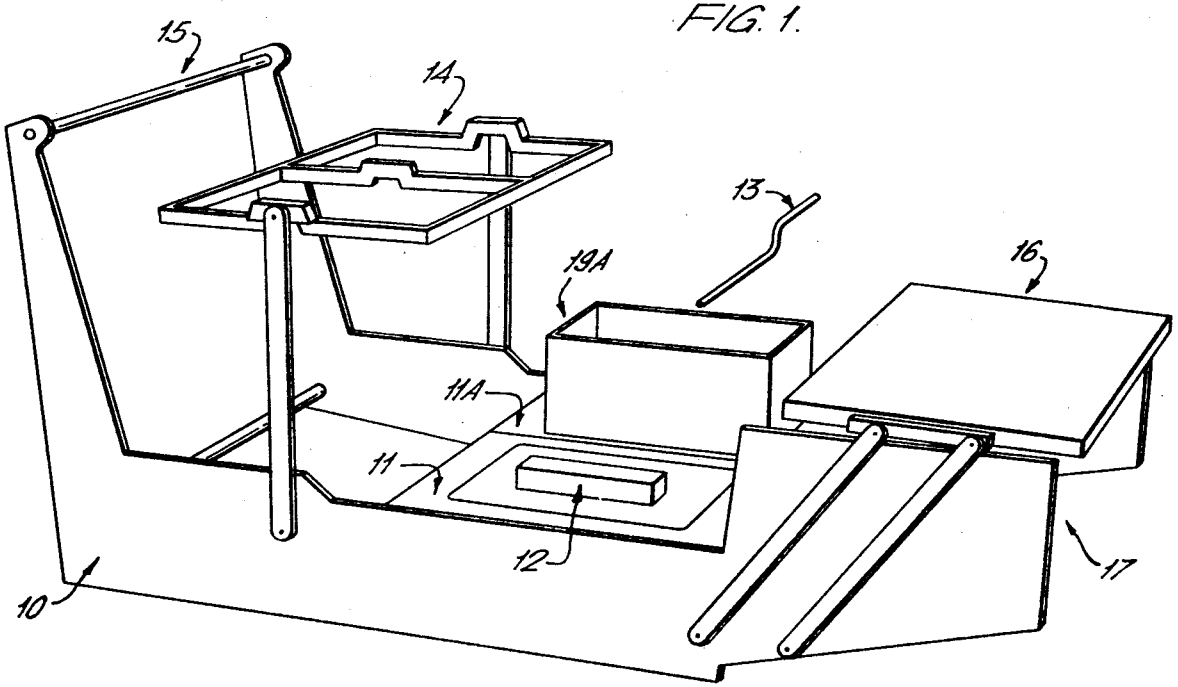

The apparatus which is illustrated in FIG. 1 comprises a support 10 on which two separate pattern plates 11, 11A are mounted. Each pattern plate 11, 11A has a pattern 12, 12A (made of aluminium alloy) secured thereto and these patterns and pattern plates have passageways extending through them into a vibratory vacuum table in the form of a hollow section of the support 10 which can be pressurised to a sub-atmospheric value by a suction pump (not shown) connected through a pipe 13. The support 10 also carries a first swinging frame 14 which transfers pieces of thin plastics material from a holder 15 to the location of the pattern plates 11, 11A. A second swinging frame 16 carries out a similar function from a second holder 17 and alternatively acts as a heat shield as will be explained. For ease of illustration a mould box half 19A is shown mounted on the pattern plate 11A, whereas the other mould box half 19 is not shown.

The components of the apparatus function in sequence so that prior to the mould box halves being located around the patterns 12, 12A the frame 14 picks up plastics sheets from the holder 15 and pauses under a radiant heater (not shown). The frame 16 swings over the two pattern plates to protect them from heat from this heater and at the same time blows a coating of fine talcum powder (or the like) over the pattern and pattern plates. The frame 14 subsequently drapes the heated plastics sheets over the respective patterns and pattern plates and the pressure within the hollow support section is reduced to below atmospheric so that the films cling but do not adhere because of the talcum powder coating. The frames 14, 16 are returned to their initial positions in sequence to permit an overhead handling device (not shown) to locate the two mould box halves on the pattern plates. The mould box halves are automatically coupled to the pipe 13 and sand is transported into the boxes as will be explained. The sand is compacted by mechanical vibration of the pattern plates 11, 11A and subsequently the frame 16 is moved to deliver sheets of heated plastics material 4 to the exposed surfaces of the sand in the respective mould box halves. Thereafter the overhead handling device removes the mould box halves with the moulded sand therein and the process is repeated for subsequently presented mould box halves. The films of plastics material may contain or have a surface covering of carbon black or other blacking applied in a predetermined pattern. Such a black covering reduces the heat loss through the plastics material and provides a degree of carbonaceous mould coating as required by the particular pattern. The radiant heaters used to heat the plastics material are conveniently wavelength adjustable by voltage adjustment and incorporate reflectors to permit both surfaces of the plastics material to be heated simultaneously.

Figure 2:
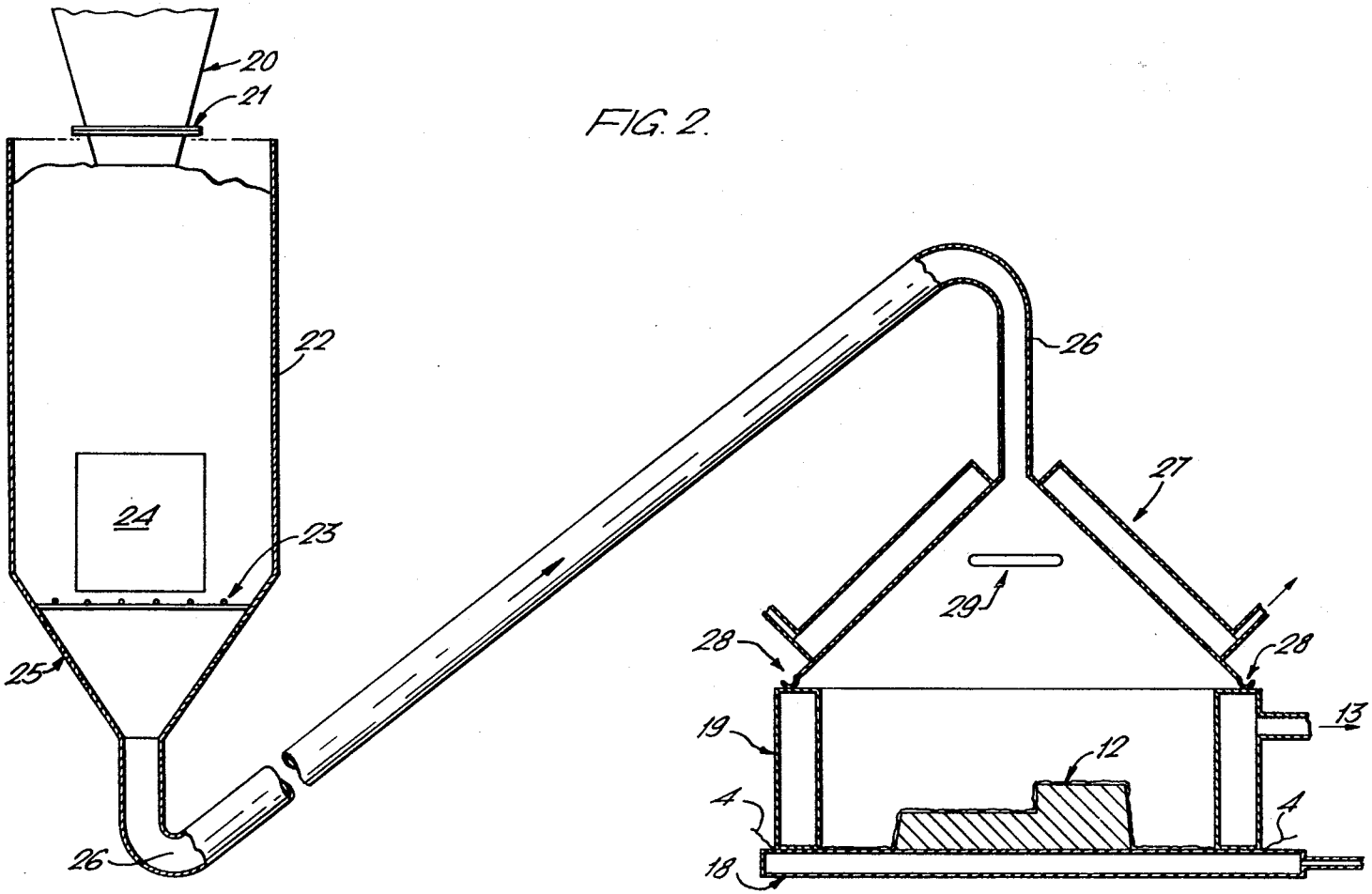
FIG. 2 illustrates sand transport apparatus.
Figure 3:
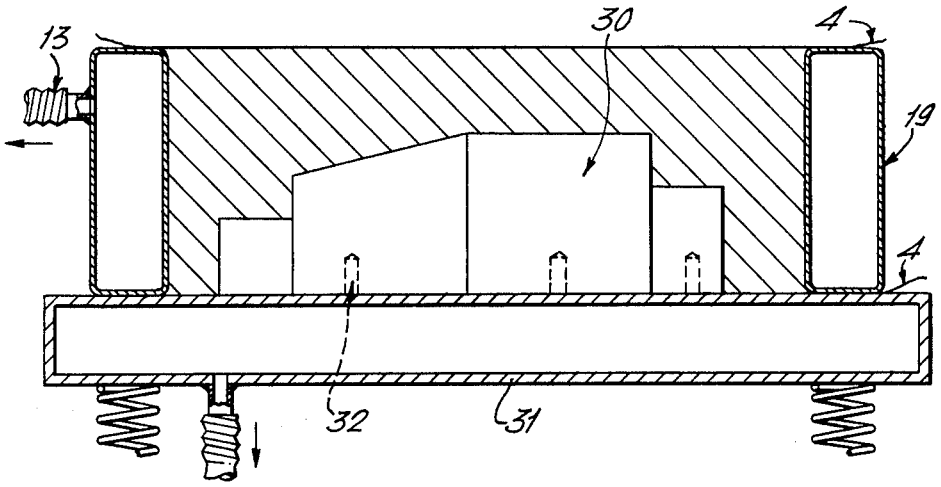
FIGS. 3–6 show the production of symmetrical mould halves without using a pattern plate.

The sand is transported by apparatus illustrated in FIG. 2 where the vibratory vacuum table 18, pattern 12 and mould box half 19 are also shown. The pattern plate 11 although not shown lies on the upper surface of the table 18. The transport apparatus includes a sand hopper 20 with gate valve 21 feeding into a holder 22 which is open to atmosphere at its upper end. Within the holder 22 there is a grid 23 which supports a ballast volume element 24 and beneath the grid 23 the walls of the holder 22 are tapered and perforated at 25, being connected to an outlet pipe 26 which at its other end opens into a hood 27 which has a flexible rubber skirt 28 enabling the hood 27 sealingly to seat on the mould box half 19. The walls of the hood 27 support a ceramic or metal baffle plate 29, are hollow in section, having perforated inner surfaces and are shaped to provide substantially even distribution of sand within the mould box half 19. The perforations 25 in the holder 22 are arranged to prevent loss of sand grains therethrough.

The sand transporter functions by reducing the pressure within the hood 27 and the mould box half 19 to sub-atmospheric. This causes sand grains within the holder 22 to be conveyed along the pipe 26. The ballast volume element 24 has the same volume as the pattern 12, the holder 22 has the same volume as the mould box half 19, and the valve 21 when operated discharges sufficient sand to fill the holder 22 to a predetermined level. To permit the plastics film to cling to the pattern 12 during transport of sand the sub-atmospheric pressure applied to the pattern 12 through the vacuum table 18 is greater than that applied to the interior of the hood 27 and the mould box half 19. Use of this sand transporter reduces the dust hazard for operators since the sand is maintained in a region of sub-atmospheric pressure.

Figure 4:
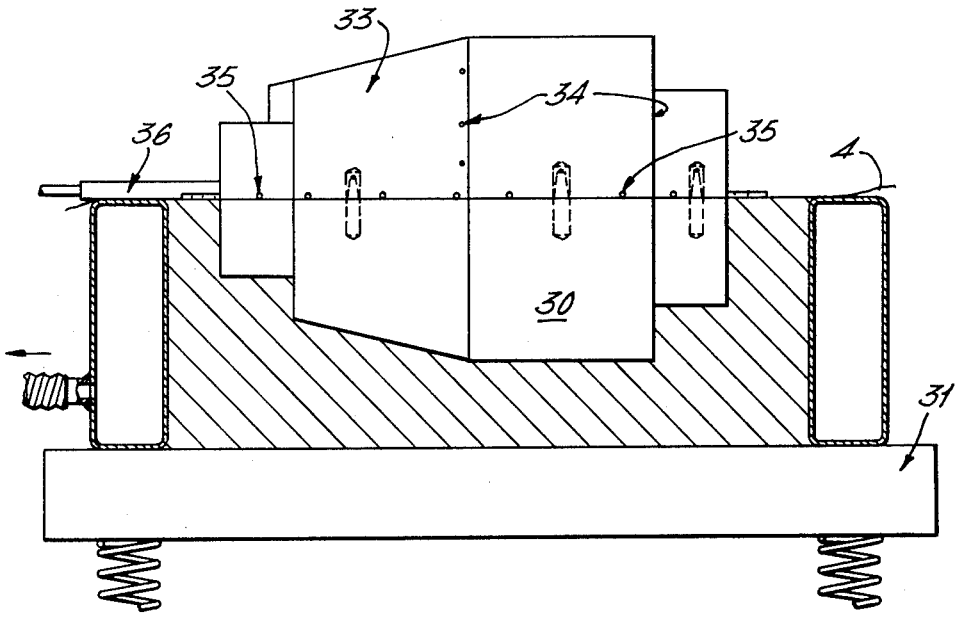

In the above-described apparatus the sand mould is formed in two halves which when brought together have a planar interface which is defined by the surface of the pattern plate 11 on which the pattern 12 is mounted. Mould halves can be produced on a modified version of the described apparatus without utilising a pattern secured to a pattern plate as will be explained with reference to FIGS. 3–8. In this arrangement a pattern half 30 is mounted without accuracy directly on a vibratory vacuum table 31 and the mould half is prepared as previously described. The pattern half 30 in addition to through passageways (not shown) incorporates dowel holes 32 for the purpose of locating the other pattern half as will be described. The formed mould half is inverted and the pattern half is retained therein as shown in FIG. 4. The other pattern half 33 is accurately positioned on the first pattern half by means of dowel pins located in the dowel holes and the other mould box half (not shown) is placed around the pattern half 33 and filled with sand as previously. The pattern half 33 also incorporates passageways 34 which in this case are interconnected with perforated tubes 35 made of plastics material and with a manifold 36 which is connected to a suction pump. The tubes 35 extend from the pattern half 33 in the plane of the mould interface and in this way the plastics film 4 can be caused to cling to the pattern half 33 prior to being submerged in sand. When the pattern halves are stripped out of the moulded sand a sand core 37 is inserted in a manner to be explained in the print 36A made by the manifold 36 so as to prevent metal run-out at this point. Provided that the tubes 35 are sufficiently small in diameter (say about 2 mm) there is no need to plug their sand impression with cores since the unwanted cast metal can be removed quite easily.

Figure 7:
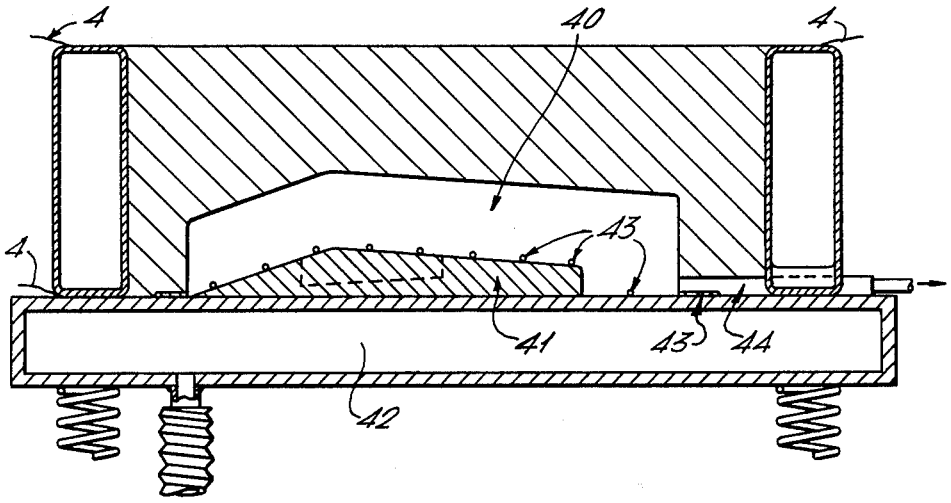
FIGS. 7 and 8 show the production of non-symmetrical mould halves.
Figure 8:
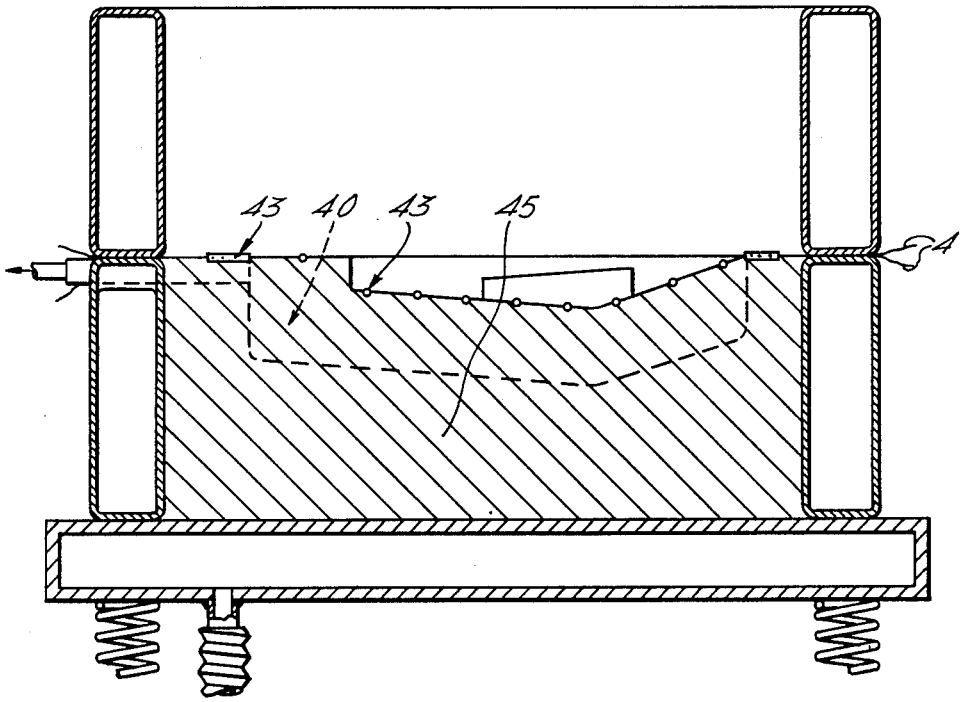

FIGS. 7 and 8 illustrate moulding from a pattern 40 which is in a single part, being non-symmetrical. The pattern 40 is mounted on a mock part 41 made of sand or plaster which is supported on the surface of a vibrating vacuum table 42. The pattern 40 has passageways extending therethrough and has a fringe of perforated tubes 43 interconnected with the passageways and with a manifold 44 which is sealingly seated in a channel through the wall of the mould box half and is connected to a suction pump. Sand is discharged on top of the pattern 40 in order to form half of the mould in the manner previously described. The half mould 45 is inverted and the pattern 40 is retained therein. The mock part 41 is removed and the second half of the mould is formed by drawing a plastics film 4 onto the exposed surface of the first half mould and pattern, loading the second mould box half with sand and drawing a further film of plastics material 4 onto the exposed surface of the second mould box half.

This method of forming a mould may be used to form an original master pattern from two half moulds which are not cast together but respectively paired with rear closure moulds in order to make two matching pattern plates with patterns integral therewith. Also, this method can be used to form castings of predominantly female form from predominantly male patterns using intermediate sacrificial moulds. In this technique a first mould is formed from the male pattern and a second mould formed directly from the first mould. The second mould is cast with a suitable closure mould and cores if necessary. In order to permit draping and vacuum forming of the plastics film for the second mould it may be necessary to perforate the abutting plastics film of the sacrificial first mould by using a perforating head as will be explained.

Figures 5, 6:
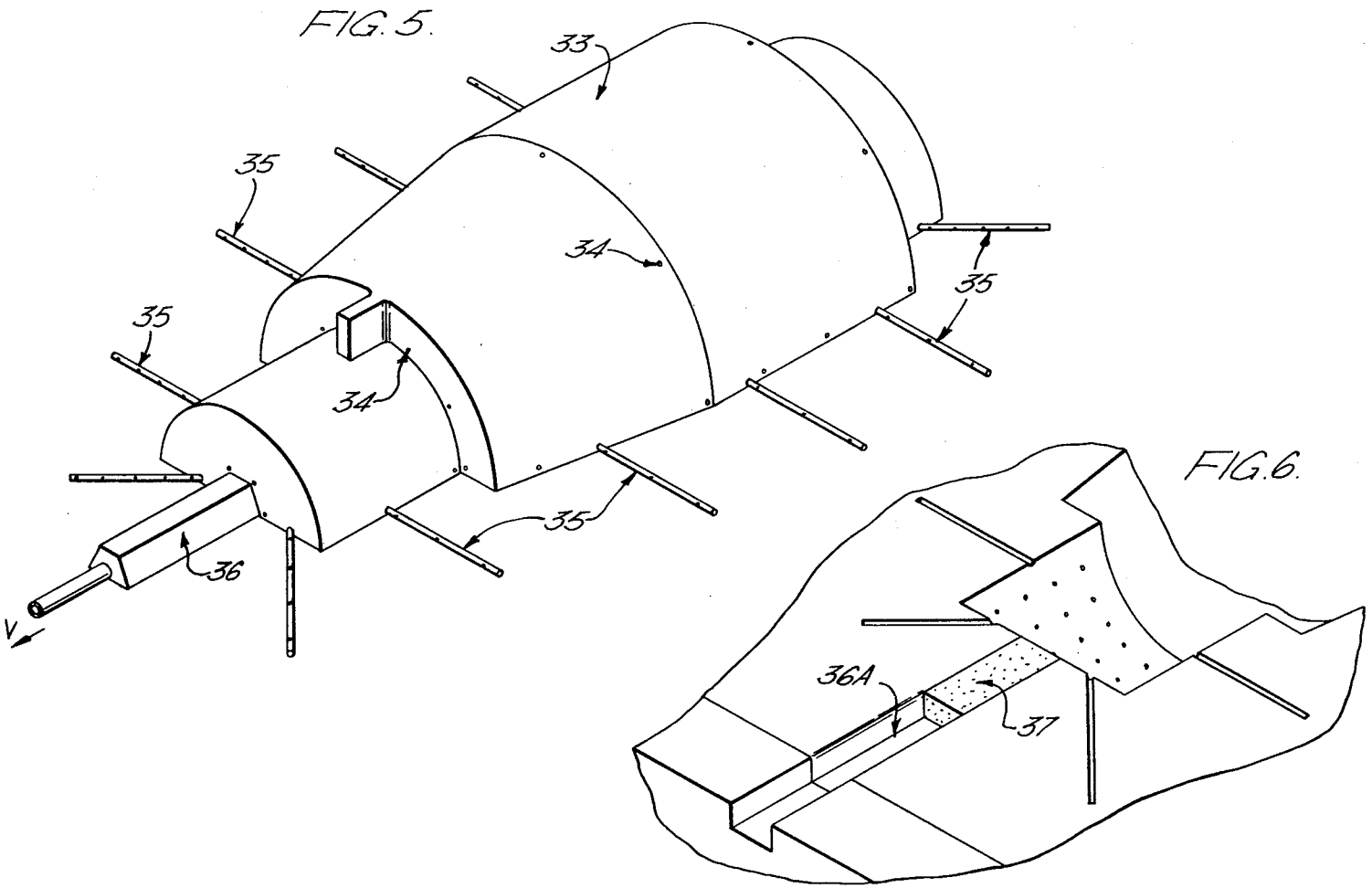

As has been explained with reference to FIG. 6, in certain circumstances it becomes necessary to locate cores within the previously formed sand mould. This may be achieved by utilising the process which is illustrated in FIGS. 9–11 or the process of FIGS. 12–15 or the process illustrated in FIG. 16.

Figure 9:
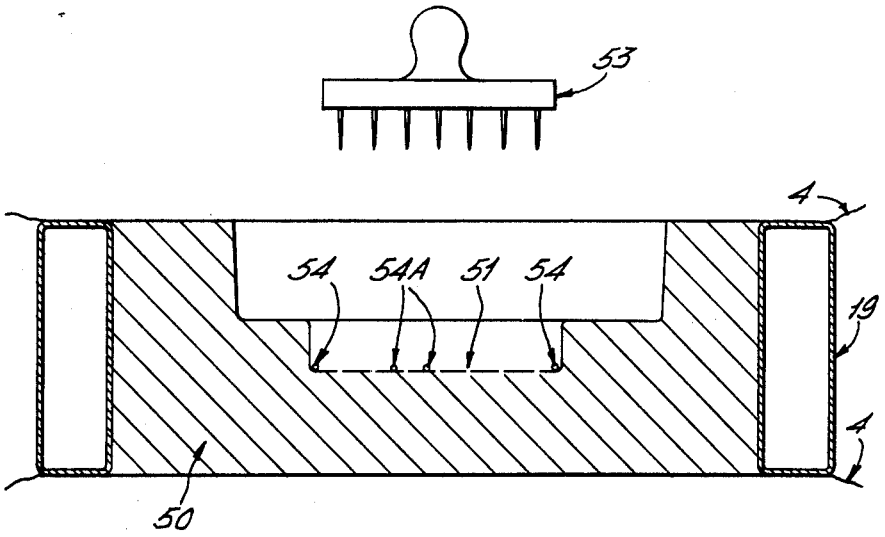
FIGS. 9–11 show a first process for locating cores within moulds.
Figure 10:
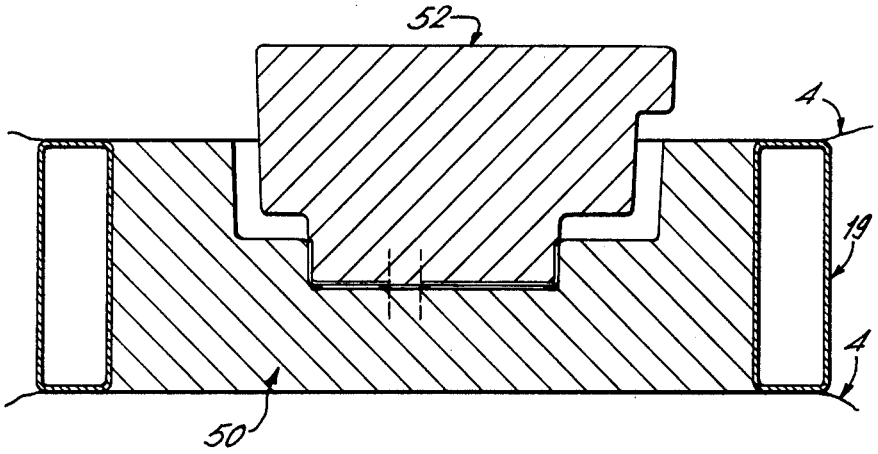
Figure 11:
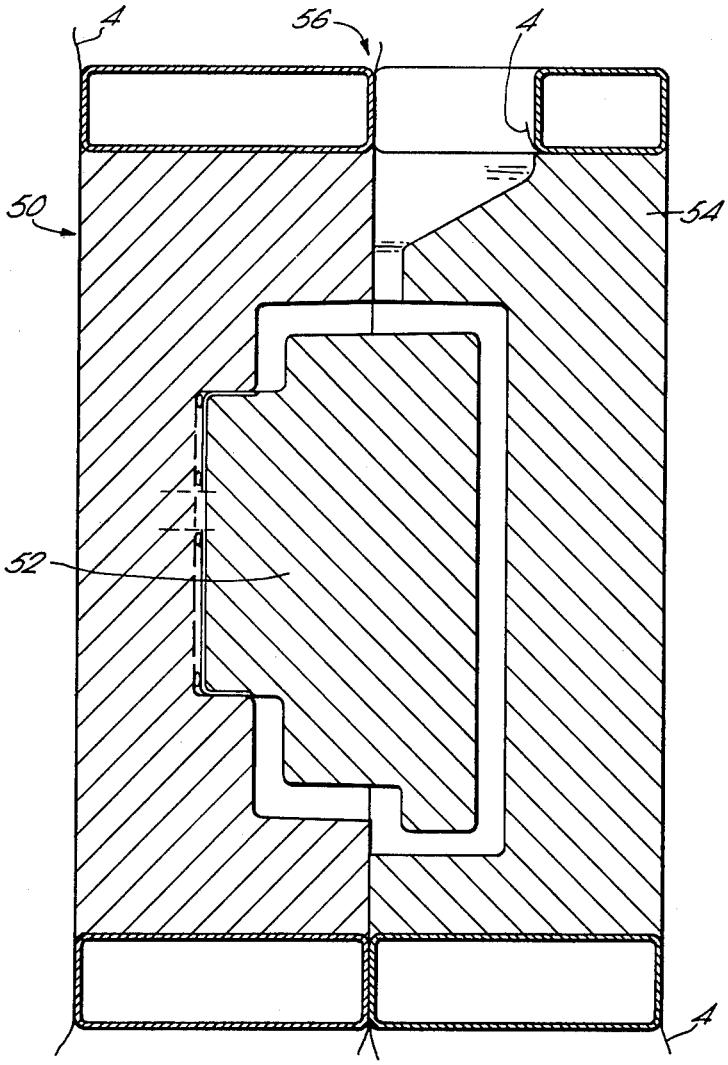
Figure 12:
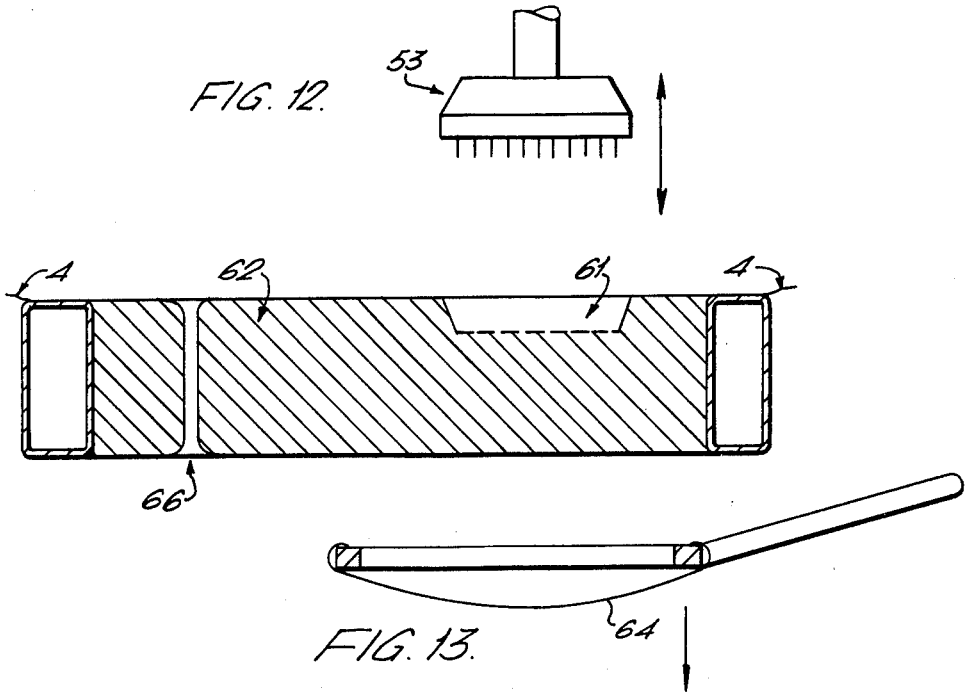
FIGS. 12–15 show a second process for locating cores within moulds.
Figure 13:
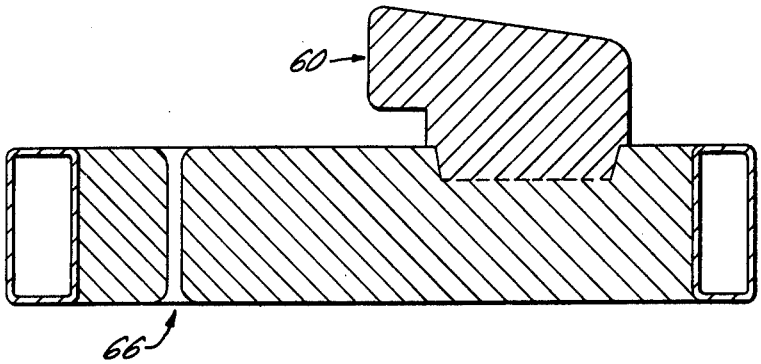
Figure 14:
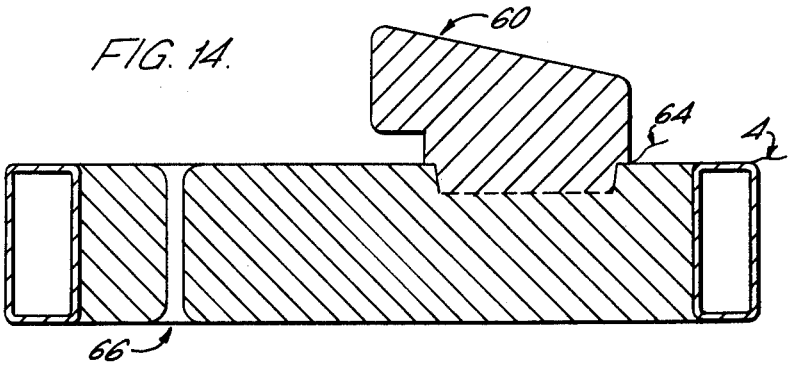
Figure 15:
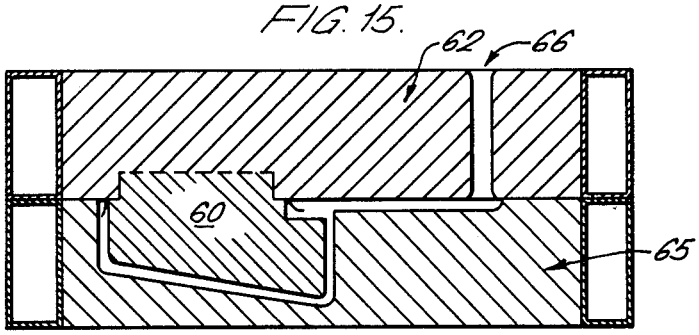

In FIGS. 9–11 a sand half mould 50 formed in the previously explained manner incorporates a core print 51 upon which an impermeable core 52 is to be located. The print 51 has a surface film of plastics material and this is perforated with a perforating head 53 and a bead of sealing material 54 is run round the periphery of the core print 51. A further bead of sealing material 54A may also be used leaving a central vent. The core 52 is thereafter provided with a core wash on its lower surface and located in the print 51 and is held in place by virtue of the sub-atmospheric pressure existing within the body of sand forming the mould 50 and which is in communication with the washed surface of the core 52. The half mould 50 may thereafter be brought together with a complimentary half mould 54 as shown in FIG. 11 and casting may be effected with the interface 56 vertically disposed. The advantage of this arrangement is that a pouring gate can be formed without affecting the outermost plastics films 4. Although the perforating head 53 is illustrated as having mechanical elements performing the perforating action the head 53 may alternatively incorporate chemical dispensing elements whereby the perforations are formed in the plastics material by chemical action.

The process shown in FIGS. 12–15 utilises a permeable core 60 which is located in a core print 61 forming part of a sand half mould 62. The print 61, as previously, is covered with a film of plastics material 4 which is punctured or perforated by the perforating head 53. Thereafter the core 60 is located in position and covered with a piece of plastics film 64. The sub-atmospheric pressure of the body of sand forming the mould causes the permeable core 60 to become surface covered with the plastics film 64 and the core 60 is held to the mould 62. The half mould 62 may be inverted provided the area of the core print 61 is sufficient to enable the pressure differential to maintain the weight of the core 60. Thus the mould half 62 may be brought together with a mould half 65 in the manner shown in FIG. 15, metal pouring taking place through a plastics-lined runner 66.

Figure 16:
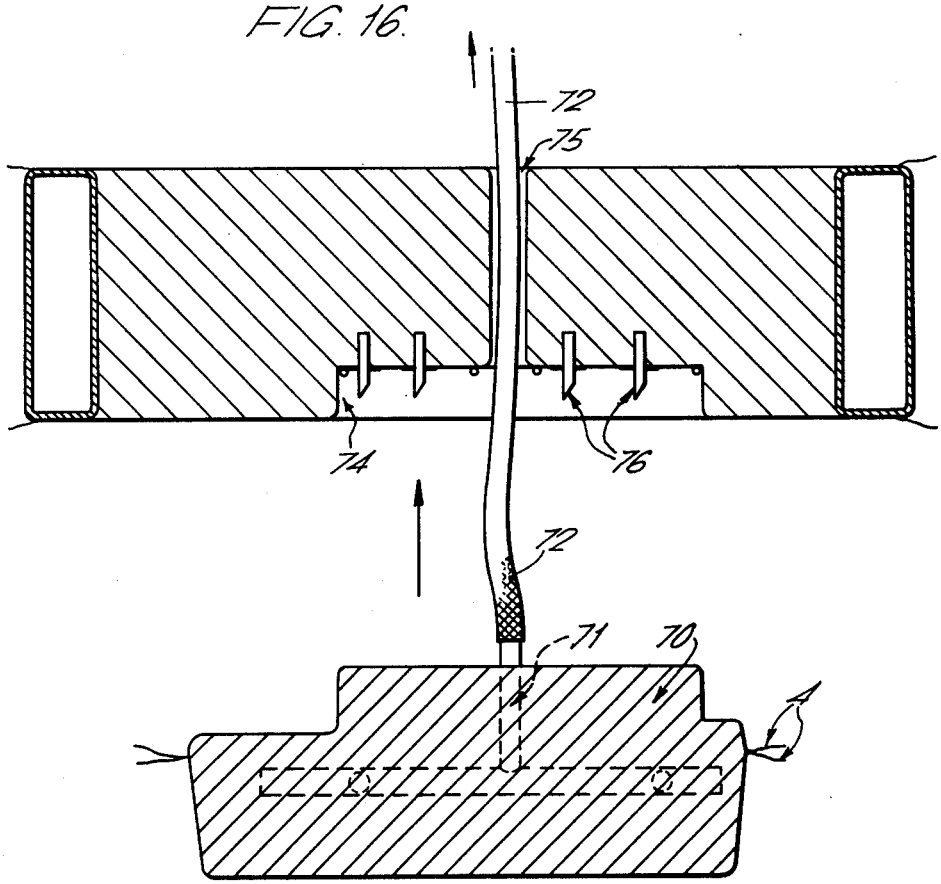
FIG. 16 shows a third process for locating cores within moulds.

The process shown in FIG. 16 utilises a core 70 which is itself formed by the V-process being in the form of a body of unbonded sand wrapped in films of plastics material 4 and maintained at sub-atmospheric pressure by a manifold 71 which is connected to a suction pump (not shown) by way of a flexible hose 72. The core print 74 in this case incorporates a plastics-lined passageway 75 through which the hose 72 passes and prior to the core 70 being brought into engagement with the core print 74 the plastics film 4 covering the surface of the print 74 is punctured with a plurality of rigid tubes 76 which subsequently puncture the plastics film surrounding the registering part of the core 70. The tubes 76 may be made of steel and conveniently are held on a retaining frame which is placed on the core 70 around the hose 72 prior to the core 70 being oppered to the core print 74. The hose 72 may alternatively be led out along the mould interface in the manner described and illustrated with reference to FIGS. 4, 5 and 5. This coring arrangement is advantageous in that it greatly facilitates the decoring of castings with large internal cavities formed by a core.

I claim:

1. A method of locating a core in a mould, which mould comprises a body of binderless moulding material located between films of thin plastics material in a mould box having hollow walls which are perforated at the interface with the body of moulding material, said body of moulding material being held together by the application of sub-atmospheric pressure to the mould box and having a plastics-film-covered surface which is contoured to define a core print, said method comprising the steps of perforating the film of plastics material at the core print, and adhering the core to the core print by the effect of suction through said perforations at the core print.

2. A method of locating a core as claimed in claim 1, wherein the core is rendered impermeable by a covering film of plastics material which is held to the core by said suction effect.

3. A method of locating a core as claimed in claim 1, wherein said core comprises a body of sand formed to desired shape by V-process moulding and a plurality of rigid pipes are interposed between the core and the core print to perforate the proximal surfaces of plastics material to produce said suction effect.

* * * * *